United States Patent [19]

Benjamin

[11] 4,191,096

[45] Mar. 4, 1980

[54] TIME DELAY ASSEMBLY

[75] Inventor: Benjamin C. Benjamin, Flint, Mich.

[73] Assignee: Schmelzer Corporation, Durand, Mich.

[21] Appl. No.: 855,360

[22] Filed: Nov. 28, 1977

[51] Int. Cl.[2] ..... F15B 15/22; F01B 29/00

[52] U.S. Cl. ..... 92/143; 92/130 R; 188/291; 192/12 A

[58] Field of Search ..... 92/143; 188/291; 192/12 A, 12 BA

[56] References Cited

U.S. PATENT DOCUMENTS

| | | | |
|---|---|---|---|
| 1,644,717 | 10/1927 | Ferrette | 92/143 |
| 1,992,912 | 2/1935 | De La Mater | 188/291 |
| 2,693,231 | 11/1954 | Morganson | 188/291 |
| 2,907,427 | 10/1959 | Dowd | 192/41 |
| 3,115,217 | 12/1963 | Butler | 192/12 BA |
| 3,227,825 | 1/1966 | Pullen | 200/36 |
| 3,638,682 | 2/1972 | Heyer | 137/624.12 |

FOREIGN PATENT DOCUMENTS

| | | | |
|---|---|---|---|
| 493571 | 2/1976 | U.S.S.R. | 192/12 BA |

*Primary Examiner*—Paul E. Maslousky

[57] ABSTRACT

A time delay device for delaying movement in one direction and permitting relatively free movement in the opposite direction wherein alternate plate members and wall members in a housing are coated with a viscous grease and the plate members are rotated through a shaft connected by a one-way clutch to the control member whose motion is to be delayed.

7 Claims, 6 Drawing Figures

Fig-1
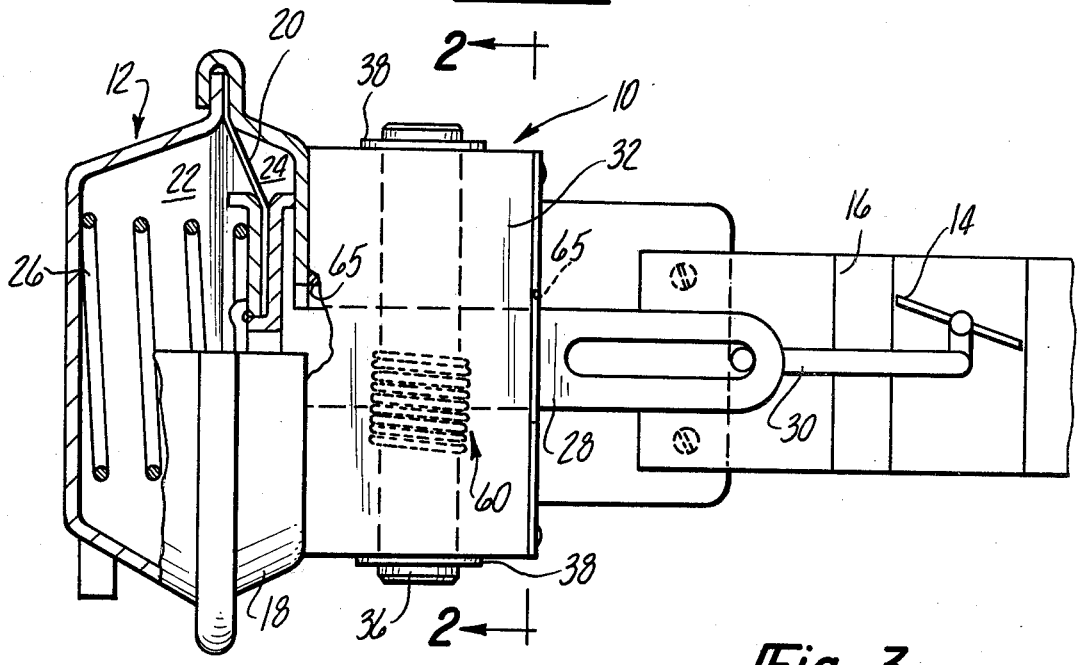
Fig-3
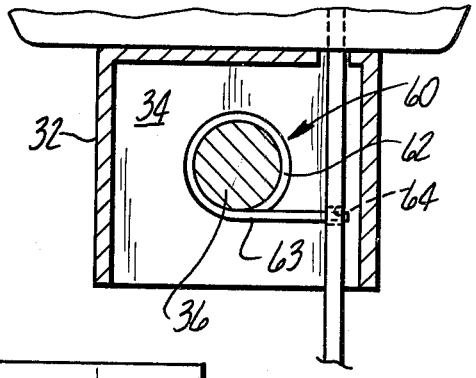
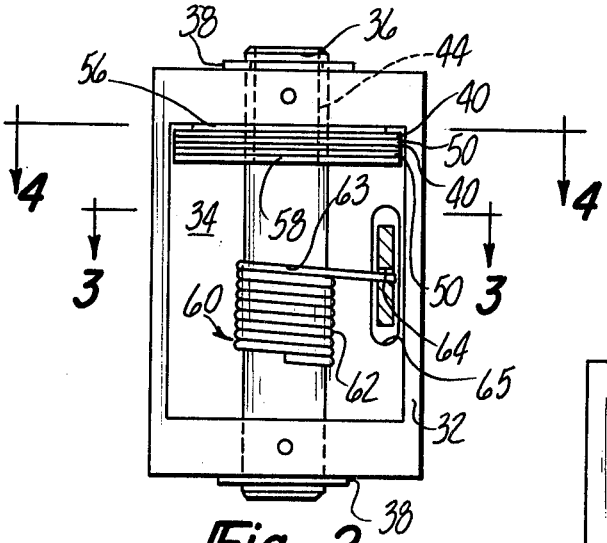
Fig-2
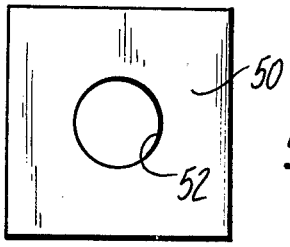
Fig-5
Fig-4
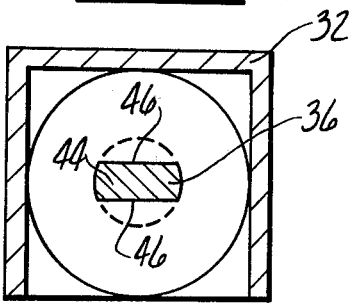
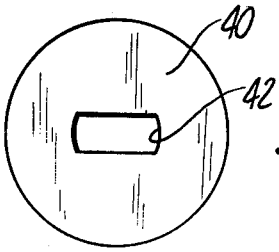
Fig-6

TIME DELAY ASSEMBLY

This invention relates to time delay devices and more particularly to time delay devices for retarding movement of a member in one direction and permitting relatively free movement in the opposite direction.

Time delay devices have various applications and in particular certain forms of delay devices are used in carburetor systems and in particular in vacuum break devices which are small vacuum motors used to move carburetor choke valves to an open position upon a starting of an internal combustion engine but at a delayed rate. One typical method of obtaining delay in vacuum break devices is by the use of bleed orifices which restrict the rate at which differential pressure is established to cause movement of a control member. Such delay structures rely on accurately shaped minute orifices which sometimes become clogged. Also, it often is desirable to provide delay which is independent of manifold vacuum pressure fluctuations.

It is highly desirable and is an object of the invention to provide a time delay device which is capable of absorbing a large amount of energy in a small amount of space and therefore is particularly adapted for use with small devices.

Still another object of the invention is to provide a time delay device which relies on the shear forces in viscous fluid adhering to relatively moving surfaces.

The objects of the invention are accomplished by a time delay device having a shaft rotatably mounted in a housing and having a plurality of plate members mounted on the shaft to rotate therewith. The plate members rotate between wall members which are mounted axially on the shaft but permit rotation of the shaft relative thereto and are non-rotatably supported relative to the housing. The adjacent surfaces of the wall members and plate members are coated with a layer of viscous material such as silicone so that upon rotation of the shaft and the plate members relative to the stationary walls, the viscous material is sheared to retard rotation of the shaft. A coil spring is wound on the shaft and is so arranged that a force applied to the spring tending to wind it more tightly on the shaft causes it to rotate with the shaft whereas a force applied in the opposite direction and tending to unwind the spring permits the latter to rotate relative to the shaft. A member is connected to one end of the spring as a result of which movement of the member in one direction is retarded by the viscous material acting between the plate and wall members and movement in the opposite direction is relatively free because the spring is allowed to rotate relative to the shaft.

These and other objects of the invention will be apparent from the following description and from the drawings in which:

FIG. 1 is a side elevation of a vacuum break device in association with a carburetor, partly in cross section and partly diagramatic and showing the time delay device of the present invention;

FIG. 2 is a sectional view taken on line 2—2 in FIG. 1;

FIG. 3 is a cross sectional view taken on line 3—3 in FIG. 2;

FIG. 4 is a cross sectional view taken on line 4—4 in FIG. 2;

FIG. 5 is a plan view of one of the wall elements used in the time delay structure; and FIG. 6 is a plan view of another element used in the time delay structure.

Referring to the drawings a time delay device is indicated at 10 and is used in conjunction with a vacuum break structure 12 in a carburetion system to control a choke valve 14 of a carburetor indicated at 16. The vacuum break includes a housing 18 divided by a diaphragm assembly 20 to form a pair of chambers 22 and 24 at opposite sides of the diaphragm assembly 20. The chamber 22 is in communication with a source of vacuum such as the intake manifold of an internal combustion engine, not shown. The chamber 24 is in continuous communication with the atmosphere. When the chamber 22 is subjected to vacuum pressure as would occur upon starting an engine, the diaphragm assembly 20 is subjected to a pressure differential and moves to the left as viewed in FIG. 1 against the action of the spring 26 to move the control member 28 to the left. Movement of the control member 28 pulls a control link 30 to open the choke valve 14. Upon termination of vacuum pressure in the chamber 22, the spring 26 returns the control member to the right.

Movement of the control member 28 to the left as viewed in FIG. 1 is retarded or delayed by the time delay device 10. The time delay device 10 includes a box like housing 32 mounted on the forward wall 31 of the vacuum break housing 18. The housing 32 has a chamber 34 with a generally square transverse cross section. A shaft 36 passes through the chamber 34 and has its opposite ends journaled in the exterior walls of the housing 32. The shaft 36 is held against axial displacement by snap rings 38 mounted at the ends of the shaft and exteriorly of the housing 32.

Disposed within the chamber 34 adjacent to one end of the shaft 36 is a plurality of relatively thin washers or plate members 40 which, as best seen in FIG. 6, have a generally rectangular opening 42 to receive a complementary reduced end portion 44 on the end of the shaft 36. The opposed flat faces 46 on the shaft seen in FIG. 4 engage the sides of the rectangular opening 42 so that the plate members 40 rotate with the shaft but can move axially relative thereto if necessary.

A plurality of square washers 50 such as those seen in FIG. 5 also are mounted within the chamber 34 at one end of the shaft 36. The square washers 50 are provided with a round opening 52 which receives the shaft 36 and permits rotation of the shaft 36 relative to the washers 50 which form wall members within the chamber 34. Because of the square perimeter of the wall members 50 they are held against rotation relative to the housng 32 and permit relative rotation of the shaft 36 as well as relative axial movement. The wall members 50 are mounted so that they are disposed at opposite sides of the plate members 40.

The plate members 40 and wall members 50 are stacked at one end of the shaft 36 and within the chamber 34 and are urged into abutting relationship with each other by a spring washer 56 seen in FIG. 2 and acting between an interior wall of the housing 34 and against one of the round washers or plates 40. The stack of plates 40 and wall members 50 are urged against an end washer 58 which is shaped like the plate members 40 but they may be made slightly thicker to form an end wall.

Prior to assembly, the plate members 40 and wall members 50 have their surfaces coated with a grease such as a silicone having a shear viscosity which does not change substantially with temperature. Rotation of the shaft 36 is resisted because the plate members 40 rotating therewith are in engagement through a layer of silicone with the abutting walls of the wall members 50. As a result substantial force is necessary to rotate the shaft in either direction and the stacked plates 40 and wall members 50 afford a large surface area of relatively moving surfaces in a small space.

The shaft 36 is connected to the output member 28 of the vacuum break 12 by way of a spring clutch arrangement 60. The spring clutch 60 includes a coil spring 62 wound on the shaft. An end coil 63 of the spring 62 extends transversely of the shaft and is positioned in an opening 64 in the control member 28. The control member 28 is free to pass through openings 65 in the housing 32. An attempt to rotate the spring relative to the shaft in a direction tending to tighten the coils on the shaft 36 causes it to grip the shaft and rotate it. On the other hand, rotation of the spring 62 in a direction tending to unwind it on the shaft 36 permits the spring 62 to rotate freely relative to the shaft. As seen in FIG. 1, movement of the output control member 28 to the left as a result of vacuum pressure in chamber 22 causes the spring 62 to be wound more tightly on the shaft 36 so that the shaft is rotated and such rotation is resisted by the shear forces in the silicone grease between the relatively rotating plate members 40 and wall members 50. On the other hand, movement of the control member 28 to the right under the action of the spring 26 tends to unwind the spring 62 so that the spring 62 is rotated relative to the shaft and movement of the control member 28 occurs without resistance of the plate members 40 and wall members 50.

It will be seen that a time delay device has been provided for delaying movement of an output or control member of a vacuum break device in the carburetor system in which relatively rotatable plate members and wall members are coated with a silicone grease so that rotation is resisted. The output member of the vacuum break device is connected to the plate members through a shaft having a clutch arrangement that requires the shaft to be rotated when the control member moves in one direction and allows the shaft to remain stationary upon movement of the control member in the opposite direction. This results in delayed movement of the control member in one direction and relatively free movement in the opposite direction.

The embodiments of the invention in which an exclusive property or privilege is claimed are defined as follows:

1. A time delay device comprising, a housing, a shaft rotatably mounted in said housing, a plate member mounted on said shaft for rotation therewith, a wall member disposed in said housing at one side of said plate member, said shaft being rotatable relative to said wall member, a layer of viscous material adhering to adjacent surfaces of said plate and wall member to retard rotation of said housing, a control member movable in opposite directions, a one-way clutch including a coil spring wound on said shaft for rotation relative to said shaft in one direction and rotation therewith in the other direction and connecting said shaft to said control member for movement of said control member independently of said shaft in one direction and with said shaft in the opposite direction, said control member forming part of a vacuum motor and being movable in one direction at a delayed rate and in the other direction at a normal rate, said housing being supported on the exterior of said vacuum motor.

2. A time delay device comprising; a housing, a shaft rotatably mounted in said housing, a plurality of circular plate members mounted concentrically on said shaft for rotation therewith, a plurality of wall members mounted on said shaft and between said plate members, said wall members having an outer periphery engaging said housing to prevent relative rotation between the wall members and said housing said shaft being rotatable relative to said wall members, a layer of viscous material adhering to adjacent surfaces of said plates and said wall members to retard rotation of said shaft relative to said housing, a control member movable in opposite directions, and means connecting said shaft to said control member for movement of said control member independently of said shaft in one direction and for movement together with said shaft in the opposite direction.

3. The combination of claim 2 wherein said means connecting said shaft to said control member is a one-way clutch comprising a coil spring wound on said shaft and having one end connected to said control member, said coil spring being rotatable relative to said shaft upon movement of said control member in one direction and for rotation with said shaft upon movement of said control member in the other direction.

4. The combination of claim 2 wherein said means connecting said control member to said shaft is a one-way clutch operatively connected to said member and to said shaft.

5. The combination of claim 4 wherein said one-way clutch comprises a coil spring wound on said shaft, said coil spring being movable for rotation relative to said shaft in one direction and for rotation therewith in the other direction.

6. The combination of claim 2 and further comprising means biasing said plate and wall members toward each other.

7. The combination of claim 6 wherein the means biasing said members is a spring mounted on said shaft and acting between said housing and one of said members.

* * * * *